US008801463B2

(12) United States Patent
Tan et al.

(10) Patent No.: US 8,801,463 B2
(45) Date of Patent: Aug. 12, 2014

(54) WATERPROOF ELECTRICAL CONNECTOR

(71) Applicants: Shi-Jie Tan, Shenzhen (CN); Shi-Ying Yang, Shenzhen (CN)

(72) Inventors: Shi-Jie Tan, Shenzhen (CN); Shi-Ying Yang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 10 days.

(21) Appl. No.: 13/740,481

(22) Filed: Jan. 14, 2013

(65) Prior Publication Data

US 2013/0183845 A1 Jul. 18, 2013

(30) Foreign Application Priority Data

Jan. 13, 2012 (CN) ..... 2012 2 0014214
Jan. 13, 2012 (CN) ..... 2012 2 0014238

(51) Int. Cl.
*H01R 13/648* (2006.01)

(52) U.S. Cl.
USPC ..... 439/607.04

(58) Field of Classification Search
USPC ..... 439/607.04, 607.35, 331, 936, 736
See application file for complete search history.

(56) References Cited

U.S. PATENT DOCUMENTS

| | | | | |
|---|---|---|---|---|
| 7,270,570 | B1 * | 9/2007 | Hamner et al. | 439/607.04 |
| 7,883,370 | B2 * | 2/2011 | Ting et al. | 439/607.35 |
| 8,025,530 | B2 | 9/2011 | Abramov | |
| 2007/0077828 | A1 * | 4/2007 | Kurahashi | 439/936 |
| 2012/0315779 | A1 | 12/2012 | Yudate et al. | |

FOREIGN PATENT DOCUMENTS

| | | | |
|---|---|---|---|
| CN | 1549407 | A | 11/2004 |
| CN | 1549407 | A | 11/2004 |
| CN | 101127348 | A | 2/2008 |
| CN | 101127348 | A | 2/2008 |
| CN | 201690049 | U | 12/2010 |
| CN | 201690049 | U | 12/2010 |
| CN | 201781111 | U | 3/2011 |
| CN | 201781111 | U | 3/2011 |
| CN | 102403618 | | 4/2012 |
| JP | 2011-090885 | | 5/2011 |

OTHER PUBLICATIONS

Qing-He Wang, Jia-Long Wang, "Plastic extrusion molding", Mar. 2009 second edition, published in China, pp. 208-211.

* cited by examiner

*Primary Examiner* — Phuong Dinh
(74) *Attorney, Agent, or Firm* — Ming Chieh Chang; Wei Te Chung

(57) ABSTRACT

An electrical connector (100) includes an inner insulative member (1), a number of contacts (2) mounted to the inner insulative member, an outer housing (3) mounted to the insulative member, and a shielding member (4). Each of the contacts includes a mounting end (23) for being mounted to an inner portion of a device. The outer housing defines a pair of mounting holes (331), and a pair of injection holes (351) respectively in fluid communication with the mounting holes. The shielding member includes a pair of mounting legs (421) inserted through respective mounting holes for being mounted to the inner portion of the device. A gap is formed between each of the mounting legs and a corresponding mounting hole. Glues seal the injection holes to prevent fluid flow from the hollow portion into the inner portion of the device.

20 Claims, 6 Drawing Sheets

WATERPROOF ELECTRICAL CONNECTOR

BACKGROUND OF THE INVENTION

1. Field of the Invention

The present invention relates to a waterproof electrical connector, and more particularly to a waterproof electrical connector adapted for being mounted to an opening defined in a device.

2. Description of Related Arts

U.S. Pat. No. 8,025,530, issued on Sep. 27, 2011, to Abramov discloses a related art. According to the disclosure, a sealed electrical connector comprises a support member, a plurality of electrically conductive elements installed in the support member, an overmold molding with the electrically conductive elements and the support member, a shield mounted on the overmold, and a gasket mounted on the shield. The overmold defines a pair of through holes. The shield comprises a pair of legs inserted through the through holes. U.S. Pub. No. 20120315779, published on Dec. 13, 2012 to Shinya et al., CN Pub. No. 102403618, published on Apr. 4, 2012, to Takeshi et al., and JP Pub. No. 2011-090885, published on May 6, 2011 to Kikuchi disclose related arts.

Therefore, the overmold provides a fluid seal around the electrically conductive elements, but not fluidly seals the legs of the shield and the overmold.

Hence, an improved electrical connector is required to overcome the above-mentioned disadvantages of the related art.

SUMMARY OF THE INVENTION

An object of the present invention is to provide an electrical connector that waterproof performance is improved.

To achieve the above-mentioned object, an electrical connector adapted for mounting to an opening defined in a device comprises: an inner insulative member, a plurality of contacts mounted to the inner insulative member, an outer housing mounted to the insulative member, and a shielding member. Each contact comprises a mating end for mating with a mating connector, a mounting end for being mounted to an inner portion of the device, and a connecting portion connecting with the mating end and the mounting end. The mounting ends of the contacts extend beyond the inner insulative member. The outer housing defines a hollow portion, a pair of mounting holes extending through the outer housing, and a pair of injection holes respectively in fluid communication with the mounting holes. The shielding member comprises a body portion and a pair of mounting legs extending from the body portion inserted through respective mounting holes for being mounted to the inner portion of the device. A gap is formed between each of the mounting legs and a corresponding mounting hole. Gules seal the injection holes to prevent fluid flow from the hollow portion into the inner portion of the device.

According to the present invention, the outer housing defines a pair of injection holes in fluid communication with the mounting holes, respectively. Therefore, glue could be injected into the mounting holes to seal the gaps formed between each of the mounting legs of the shielding member and the mounting holes.

DETAILED DESCRIPTION OF THE PREFERRED EMBODIMENT

Figure 1:
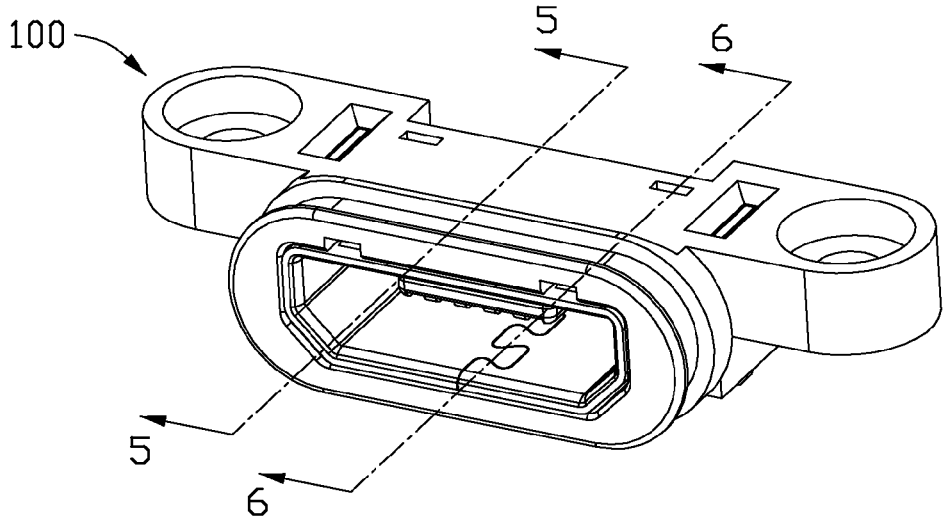
FIG. 1 is a perspective view of an electrical connector in accordance with the present invention.
Figure 2:
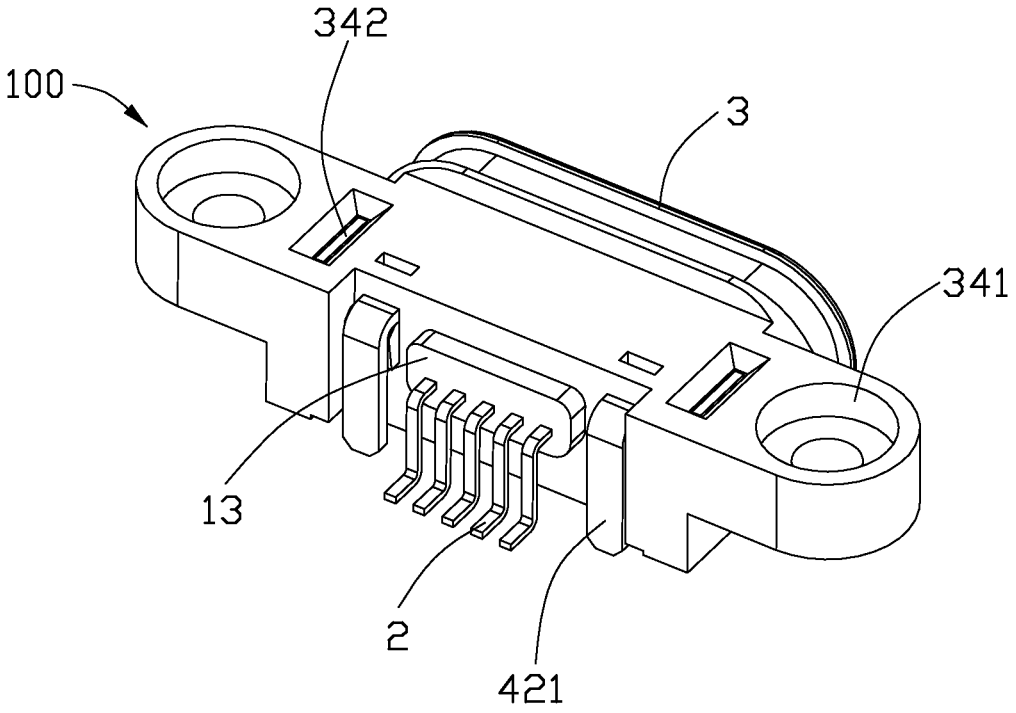
FIG. 2 is another perspective view of the electrical connector as shown in FIG. 1.

Reference will now be made in detail to a preferred embodiment of the present invention.

Referring to FIGS. 1 to 6, an electrical connector 100 adapted for being for mounted to an opening defined in a device (not shown), such as a mobile phone, comprises an inner insulative member 1, a plurality of contacts 2 mounted to the inner insulative member 1, an outer housing 3 overmolded around the inner insulative member 1, a shielding member 4, and a pair of retention members 5 for fixing the electrical connector to the device.

Referring again to FIGS. 3 to 5, the inner insulative member 1 comprises a base portion 11 and a tongue portion 12 extending from the base portion 11. The base portion 11 comprises a front face 111, a rear face 112 opposite to the front face 111, and a plurality of side faces 113 connecting with the front face 111 and the rear face 112. The base portion 11 defines a recess 114. The recess 114 has an annular shape extending along an outer circumference of the base 11. The tongue portion 12 comprises a bottom surface 121 defining a plurality of contact cavities 122 for receiving the contacts 2 and plurality of holes 123 extending along a direction perpendicular to an extending direction of the contact cavities 122 through the bottom surface 121.

Referring to FIGS. 2 to 6, each of the contacts 2 comprises a mating end 21 for mating with a mating contact (not shown), a mounting end 23 for being overmolded around an inner portion of the device, and a connecting portion 22 connecting with the mating end 21 and the mounting end 23. The mating end 21 of the contacts 2 are disposed on the tongue portion 12 of the inner insulative member 1. The contacts 2 are insert molded with the inner insulative member 1, with the mounting ends 23 of the contacts 2 extending beyond the inner insulative member 1. Therefore, the contacts are sealingly connected with the inner insulative member 1 to prevent fluid flow from the inner insulative member 1 and the contacts 2 into the inner portion of the device.

The outer housing 3 is overmolded with the inner insulative member 1. The outer housing 3 comprises a front face 31 and an opposite rear face 33. The outer housing 3 defines a hollow portion 32 extending through the front face 31 of the outer housing 3. The outer housing 3 comprises a pair of mounting portions 34 located at opposite sides of the rear base portion 35 of the outer housing 3 for being mounted to the device. Each of the mounting portions 34 defines a stepped mounting hole 341 and a fixing hole 342 adjacent to the stepped mounting hole 341. Each of the mounting portions 34 has an inverted-L shape. The outer housing 3 forms a projection portion 314 fully filled with the recess 114 of the base 11 to provide a reinforced connection between the outer housing 3 and the inner insulative member 1. The inner insulative member 1 has a portion extending beyond the rear face 33 of the outer housing 3 to form a shoulder 13 for being accurately fixed by mould in the over molding process. The outer housing 3 defines a pair mounting holes 331 extending through the rear face 33 of the outer housing 3 along a horizontal direction, and a pair of injection holes 351, which is formed in the rear base portion 35, in fluid communication with the mounting holes 331, respectively. The injection holes 351 extend along a direction perpendicular to the horizontal direction. The outer housing 3 comprises a pair of supporting portions 332 projected rearwardly from the rear face 33. Each of the supporting portions 332 is disposed below a corresponding mounting hole 331. The outer housing 3 defines an annular slot (not labeled) in the front portion for receiving a gasket (not shown) for sealing some gaps between the outer housing 3 and the opening of the device. Therefore, the outer housing 3 is tightly molded around and sealingly engaged with the inner insulative member 1 to prevent fluid flow from the hollow portion into the inner portion of the device. The tongue portion 12 is received into the hollow portion 32.

Figure 3:
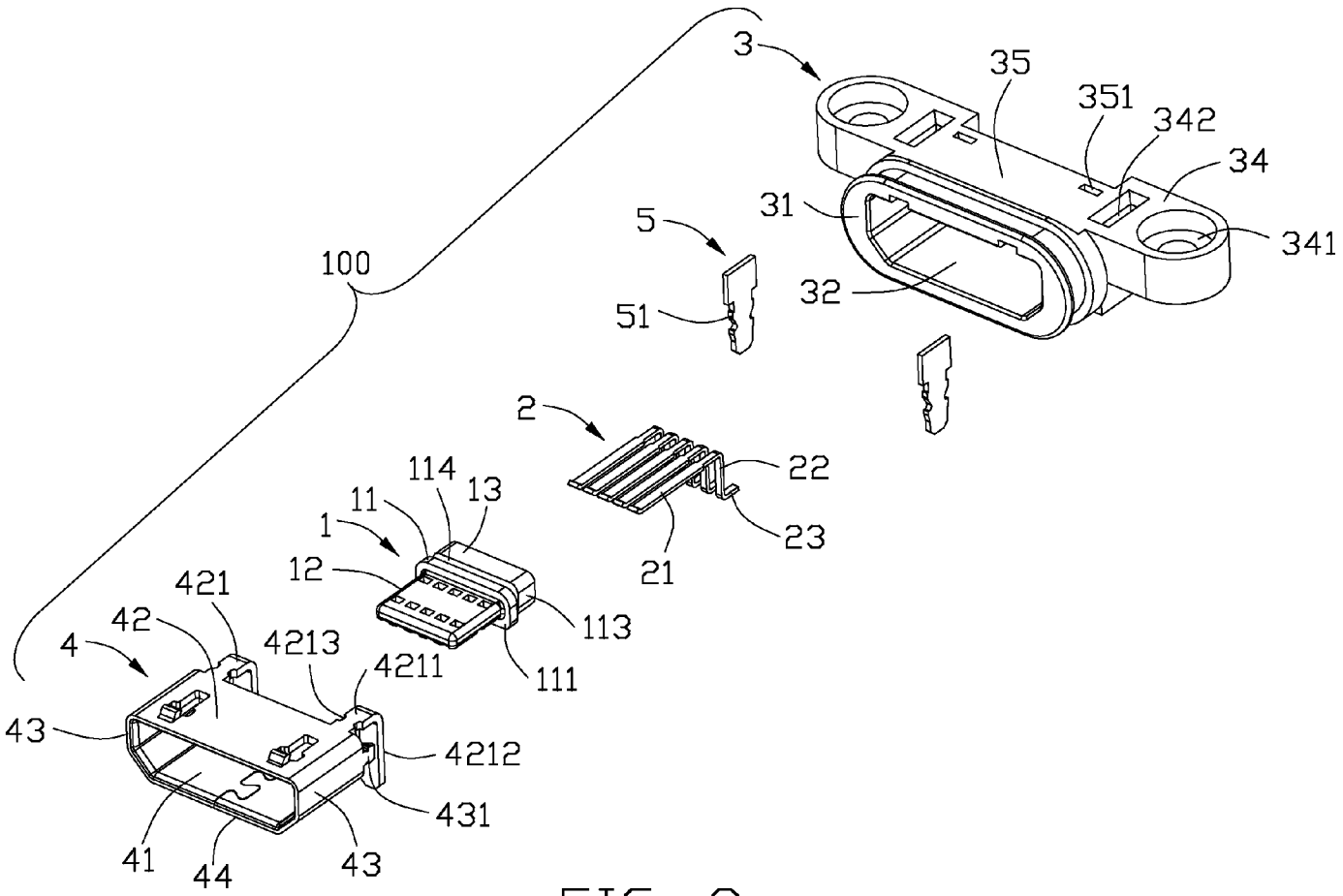
FIG. 3 is an exploded view of the electrical connector as shown in FIG. 1.
Figure 4:
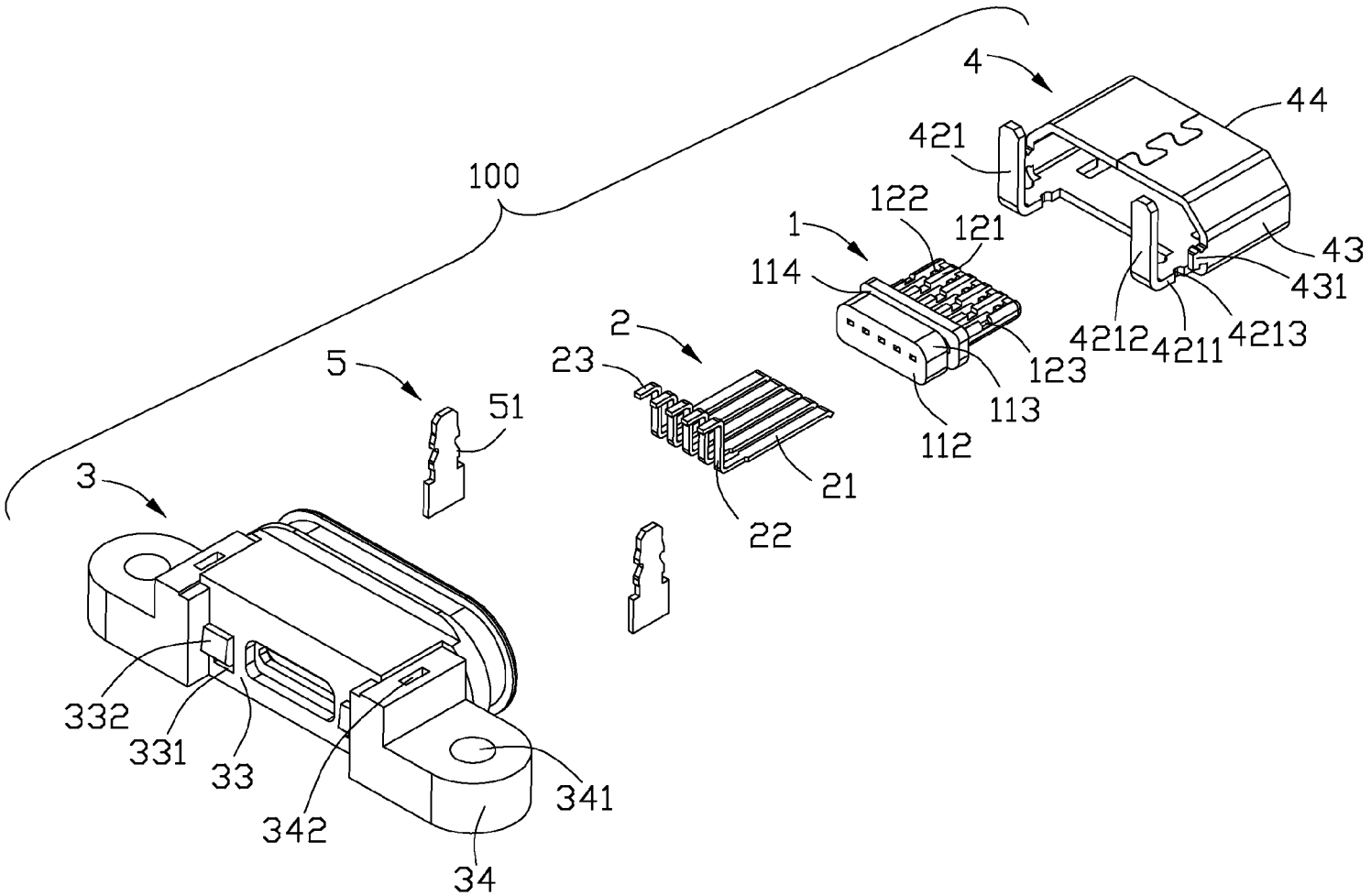
FIG. 4 is another exploded view of the electrical connector as shown in FIG. 3.
Figure 5:
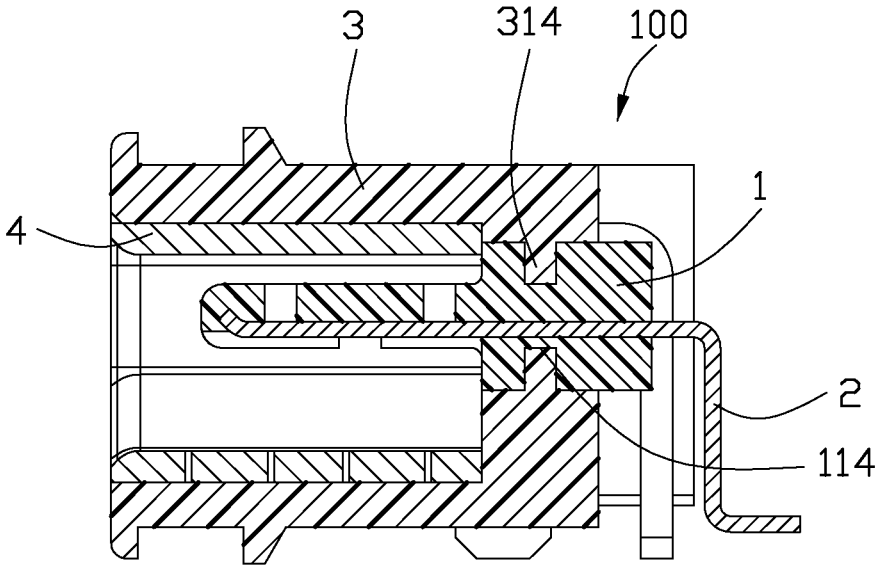
FIG. 5 is a cross-sectional view of the electrical connector taken along line 5-5 of FIG. 1.
Figure 6:
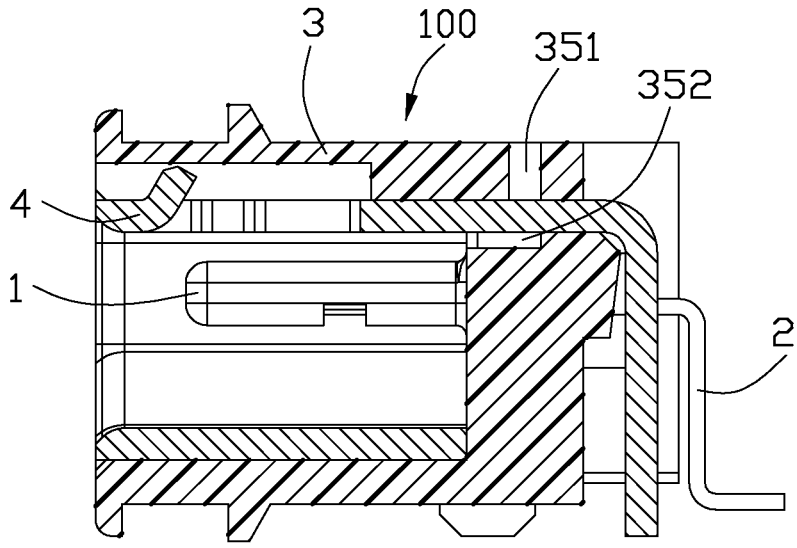
FIG. 6 is a cross-sectional view of the electrical connector taken along line 6-6 of FIG. 1.

Referring to FIGS. 3 and 4, the shielding member 4 comprises a body portion received in the hollow portion 32, and a pair of mounting legs 421 extending from the body portion. The body portion comprises a top wall 42, a pair of side walls 43 extending from an opposite side of the top wall 42 downwardly, and a bottom wall 44 opposite to the top wall 42. Each of the side walls comprises a retention portion 431 extending rearwardly for being retained into the outer housing 3. The mounting legs 421 extend from the top wall 42. The top wall 42, the side walls, and the bottom wall 44 cooperate to form a receiving space 41. Each of the legs 421 comprises a first portion 4211 extending along a horizontal direction, and a second portion 4212 extending from a rear end of the first portion 4211 along a vertical direction for being mounted to the inner portion of the device. The first portion 4211 defines a pair of cutouts 4213 symmetrically with each. The legs 421 of the shielding member 4 are inserted through the mounting holes 331 of the outer housing 3, respectively for being mounted to the inner portion of the device. Each of the first portions 4211 is received in one of the mounting hole 331. Some gaps 352 are formed between the each of the first portions 4211 and the corresponding mounting hole 331 sealed with glue through the corresponding injection hole 351 to prevent fluid flow from the hollow portion 32 into the inner portion of the device. The gaps 352 communicate with each by the cutouts 4213. Therefore, the glue can fully fill with the gaps through the cutouts 4213. Each of the second portions 4212 is supported by the corresponding supporting portion 332. The tongue portion 12 of the inner insulative member 1 is received into the receiving space 41. The mating ends 21 of the contacts 2 are exposed to the hollow portion 32.

Each of the retention members 5 has a strip shape comprising a plurality of tabs 51 disposed at opposite sides of thereof. Each of the retention members 5 is received in and extending beyond the corresponding fixing hole 342 for fixing to the device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mounting to an opening defined in a device, comprising:

an inner insulative member;

a plurality of contacts mounted to the inner insulative member, each contact comprising a mating end for mating with a mating connector, a mounting end for being mounted to an inner portion of the device, and a connecting portion connecting with the mating end and the mounting end, the mounting ends of the contacts extending beyond the inner insulative member;

an outer housing mounted to the inner insulative member, the outer housing defining a hollow portion, a pair of mounting holes extending through the outer housing, and a pair of injection holes respectively in fluid communication with the mounting holes;

a shielding member comprising a body portion and a pair of mounting legs extending from the body portion, inserted through respective mounting holes for being mounted to the inner portion of the device, a gap being formed between each of the mounting legs and a corresponding mounting hole; and glues sealing the injection holes to prevent fluid flow from the hollow portion into the inner portion of the device.

2. The electrical connector as recited in claim 1, wherein said outer housing overmolds with the inner insulative member.

3. The electrical connector as recited in claim 2, wherein said inner insulative member comprises a base portion defining a recess to provide a reinforced connection with the outer housing.

4. The electrical connector as recited in claim 2, wherein said inner insulative member comprises a tongue portion extending into the hollow portion, the mating ends of the contacts disposed on the tongue portion.

5. The electrical connector as recited in claim 4, wherein the body portion is received in the hollow portion and defines a receiving space, the tongue portion received into the receiving space.

6. The electrical connector as recited in claim 2, wherein the inner insulative member has a portion extending beyond the outer housing for being fixed by a mould during overmolding process.

7. The electrical connector as recited in claim 1, wherein each of the mounting legs defines at least one cutout to communicate with the mounting hole.

8. The electrical connector as recited in claim 7, wherein there are a pair of cutouts defined symmetrically to each other.

9. The electrical connector as recited in claim 1, wherein the contacts are overmolded with the inner insulative member.

10. The electrical connector as recited in claim 1, further comprising a gasket, and wherein the outer housing defines an annular slot receiving the gasket.

11. The electrical connector as recited in claim 1, wherein the mounting holes extend along a first direction, and the injection holes extend along a second direction perpendicular to the first direction.

12. The electrical connector as recited in claim 1, further comprising a pair of retention members for fixing the electrical connector to the device.

13. An electrical connector comprising:

an inner insulative member defining a base and a mating tongue forwardly extending therefrom along a front-to-back direction;

a plurality of contacts integrally formed, via an insert molding process, with said inner insulative member and defining a front mating section exposed upon the mating tongue and a rear mounted section exposed outside of the base;

an outer insulative member integrally formed, via an overmolding process, upon the inner insulative member after the inner insulative member is formed with the contacts thereon, said outer insulative member defining a rear base portion circumferentially engaged with the base of the inner insulative member, and a front frame portion forwardly extending from the rear base portion and enclosing the mating tongue therein;

at least one mounting hole extending through the rear base portion in said front-to-back direction and at least an injection hole outwardly communicating with an exterior and inwardly transversely communicating with the mounting hole under an intersectional manner; and a metallic shell adapted to be assembled to the outer insulative member after the outer insulative member is formed with the inner insulative member, said shell generally located between the outer insulative member and the inner insulative member, and defining a body portion within the front frame portion of the outer insulative member to enclose the mating tongue, and at least a mounting leg snugly extending through the mounting hole with a tiny gap therebetween and out of a rear face of the outer insulative member; wherein:

glues seals said gap around an intersection area of said mounting hole and said injection hole via injecting said glues into the injection hole.

14. The electrical connector as claimed in claim 13, wherein said outer insulative member defines in the front frame portion a groove extending along the front-to-back direction to receive an upwardly flared tab of the shell which is used to lock a latch of a complementary connector.

15. The electrical connector as claimed in claim 13, wherein the leg defines a cutout around the intersection of the mounting hole and the injection hole to allow the glues to transversely pass and efficiently surround the leg for fully filling the gap.

16. The electrical connector as claimed in claim 13, wherein the outer insulative member defines an oblique part on the rear face of the outer insulative member so as to allow the leg to be bent toward said oblique part after the leg extends through the mounting hole in an intermediate horizontal position so as to reach a final vertical position.

17. The electrical connector as claimed in claim 13, wherein said inner insulative member defines a rear edge section extending rearwardly beyond the rear face of the outer insulative member for overmolding consideration of said outer insulative member over the inner insulative member.

18. The electrical connector as claimed in claim 13, wherein said injection hole is perpendicular to said mounting hole.

19. An electrical connector comprising:

an inner insulative member defining a base and a mating tongue forwardly extending therefrom along a front-to-back direction;

a plurality of contacts integrally formed, via an insert molding process, with said inner insulative member and defining a front mating section exposed upon the mating tongue and a rear mounted section exposed outside of the base;

an outer insulative member integrally formed, via an overmolding process, upon the inner insulative member after the inner insulative member is formed with the contacts thereon, said outer insulative member defining a rear base portion circumferentially engaged with the base of the inner insulative member, and a front frame portion forwardly extending from the rear base portion and enclosing the mating tongue therein;

at least one mounting hole extending through the rear base portion in said front-to-back direction; and a metallic shell adapted to be assembled to the outer insulative member after the outer insulative member is formed with the inner insulative member, said shell generally located between the outer insulative member and the inner insulative member, and defining a body portion within the front frame portion of the outer insulative member to enclose the mating tongue, and at least a mounting leg snugly extending through the mounting hole with a tiny gap therebetween and out of a rear face of the outer insulative member; wherein glues seals said gap around a position distantly isolated from the rear face of the outer insulative member.

20. The electrical connector as claimed in claim 19, wherein said outer insulative member defines an injection hole distantly spaced from the rear face of the outer insulative member, through which said glues are injected to approach the mounting hole.

* * * * *